United States Patent [19]

Soules, Jr.

[11] Patent Number: 4,834,581

[45] Date of Patent: May 30, 1989

[54] ROOT CUTTING CABLE LAYING PLOW

[76] Inventor: John W. Soules, Jr., Box 1010, Sundown, Tex. 79372

[21] Appl. No.: 164,349

[22] Filed: Mar. 4, 1988

[51] Int. Cl.[4] ..... E02F 5/10; F16L 1/02; A02B 15/00

[52] U.S. Cl. ..... 405/182; 405/180; 172/606; 172/699; 37/193

[58] Field of Search ..... 405/180–183, 405/174; 172/40, 606, 609, 699; 37/193

[56] References Cited

U.S. PATENT DOCUMENTS

| | | | |
|---|---|---|---|
| 1,271,882 | 7/1918 | Ford | 172/609 |
| 2,184,211 | 12/1939 | Croy | 172/609 |
| 3,011,278 | 12/1961 | Lust | 37/193 |
| 3,286,476 | 11/1966 | MacLay . | |
| 3,326,010 | 6/1967 | Gagne | 405/182 |
| 3,348,383 | 10/1967 | Kelley . | |
| 3,405,533 | 10/1968 | Fries . | |
| 3,608,322 | 9/1971 | Kinnan et al. . | |
| 3,706,207 | 12/1972 | Cornelius et al. | 37/193 X |
| 3,726,099 | 4/1973 | Ruge . | |
| 3,757,529 | 9/1973 | Kaercher | 172/40 X |
| 3,777,500 | 12/1973 | Kelley | 37/193 X |
| 3,802,210 | 4/1974 | D'Andrea . | |
| 3,831,299 | 8/1974 | Kelley | 37/193 X |
| 4,200,410 | 4/1980 | Baker et al. | 405/182 |

FOREIGN PATENT DOCUMENTS

| | | | |
|---|---|---|---|
| 971580 | 7/1975 | Canada | 172/40 |
| 3317053 | 11/1984 | Fed. Rep. of Germany | 405/182 |
| 320249 | 1/1972 | U.S.S.R. | 172/40 |
| 635186 | 11/1978 | U.S.S.R. | 405/174 |
| 968218 | 10/1982 | U.S.S.R. | 37/193 |
| 1188256 | 10/1985 | U.S.S.R. | 405/182 |

*Primary Examiner*—Dennis L. Taylor
*Assistant Examiner*—John A. Ricci
*Attorney, Agent, or Firm*—Crutsinger & Booth

[57] ABSTRACT

A root cutting cable laying plow adapted for attachment to a tractor is provided. The plow includes a shank having a longitudinal blade formed in the leading edge of a lower portion of the shank and having a flat transverse cutting surface above the blade. A cutter having a sharpened lower end is movable with respect to the shank into engagement with the flat cutting surface by a double acting hydraulic cylinder. The cutter and the cylinder rod move between parallel mounting flanges of the tractor, allowing the hydraulic cylinder itself to be attached to the shank above the mounting flanges.

11 Claims, 1 Drawing Sheet

ROOT CUTTING CABLE LAYING PLOW

BACKGROUND OF THE INVENTION

This invention relates generally to cable laying plows and more particularly concerns a cable laying plow adapted for cutting roots and vegetable matter accumulating on and about the plow as it is used to lay cable.

Heretofore, specialized cable laying plows have been used to bury cable such as telephone cable beneath the surface of the earth. Such plows have typically been attached to and dragged behind a vehicle such as a crawler tractor. The plow itself is often a steel shank angled downward and forward and having a sharpened leading edge. A vibrating device having, for example, an unbalanced rotating shaft, may be interposed between the tractor and the shank to assist the shank in breaking the soil. The shank is followed by a cable chute connected to the trailing edge of the shank through which the cable is placed into the trench cut by the plow.

As the shank is dragged through the earth, it commonly encounters vegetable matter in the earth such as tree roots and the like. More deeply buried roots, for example those buried more than two feet deep, are generally confined by the weight of the soil overburden above them and are more easily snapped in place by the shank at the point of contact of the root with the shank. Typically, all portions of a root that is snapped in this manner remain in the earth and do not foul the plow.

Roots nearer to the surface of the earth, for example in the uppermost twelve inches, are more likely to foul the shank. Movement of these surface roots is less restricted by the smaller confining weight of overburden. Additionally, in some soils, the surface soils are less confining, being less consolidated than deeper soils or containing more organic matter. The reduced tendency of the surface soils to confine roots causes the plow to push a root rather than to snap it. As the root is pushed, it may be stretched and eventually may break under tension at a point other than the point of contact with the shank, leaving a segment of the root wrapped about the shank.

As the shank is dragged through the earth, other root segments accumulate about the shank, particularly about its upper end. If an angled plow shank is used, forward motion of the plow urges deeper root segments to the upper end of the shank. As these roots accumulate, their mass effectively increases the width of the shank, thereby increasing both the width of the trench and the effort required to cover the trench after the cable is laid. The resistance of the earth to the forward motion of the plow compacts the root segments tightly about the shank. Eventually, the root mass must be removed from the shank such as by laborers with axes, which manual removal can require as long as thirty minutes.

Vegetation cutting or cleaning plows have been suggested in attempts to address this problem. U.S. Pat. No. 3,777,500 to Kelley discloses vegetation cutting structure for cutting both the earth and vegetation lying in the path of the plow. Kelley's plow has continuously reciprocating saw teeth along the entire leading edge of its shank to "saw" through the earth and through any vegetation therein such as grasses. U.S. Pat. No. 3,831,299 to Kelley discloses a cable laying plow that resembles a chain saw.

U.S. Pat. No. 3,706,207 to Cornelius discloses in one embodiment continuously reciprocating saw teeth along the leading edge of the shank. In another embodiment, Cornelius discloses a straight leading edge shank above a reciprocating projecting tip. The gap between the lower flat edge of the shank and the upper flat surface of the tip expands and contacts as the tip reciprocates. However, it appears that root material entering this gap may lodge behind and under the reciprocating tip, eventually encumbering its reciprocation.

U.S. Pat. No. 4,200,410 to Baker discloses a fixed knife edge at the surface of the earth to cut roots, and, in a separate embodiment, fixed saw teeth.

Accordingly, it is an object of this invention to provide an improved root cutting cable laying plow.

It is a further object of this invention to provide a root cutting cable laying plow capable of cutting accumulated roots and vegetable matter from the plow.

SUMMARY OF THE INVENTION

In accordance with the invention, a root cutting cable laying plow adapted for attachment to a tractor is provided. The plow includes a shank having a longitudinal blade formed in the leading edge of a lower portion of the shank and having a flat transverse cutting surface above the blade. A cutter having a sharpened lower end is movable with respect to the shank into engagement with the flat cutting surface by a double acting hydraulic cylinder. The cutter and the cylinder rod move between parallel mounting flanges of the tractor, allowing the hydraulic cylinder itself to be attached to the shank above the mounting flanges.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that the description is not intended to limit the invention to that embodiment. On the contrary, the description is intended to cover all alternatives, modifications and equivalents as may be included within the spirit and scope of the invention as defined by the appended claims.

DETAILED DESCRIPTION OF THE INVENTION

Figure 2:
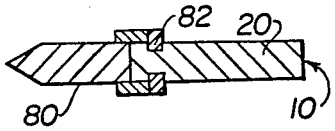
FIG. 2 is a sectional view taken along lines 2—2 of FIG. 1.
Figure 1:
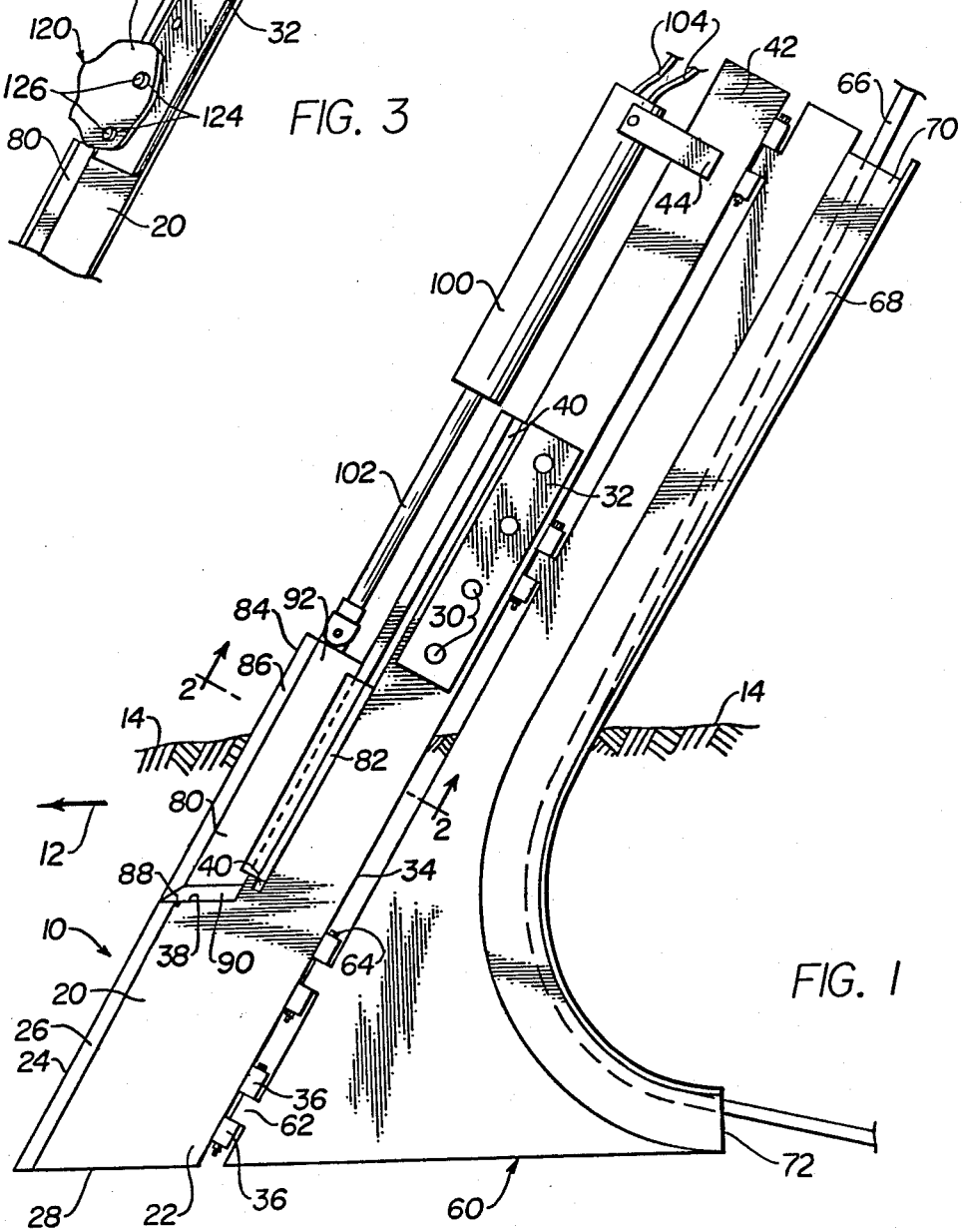
FIG. 1 is an elevation of the root cutting cable laying plow of the invention.

Turning now to the drawing and first to FIGS. 1 and 2, there is shown a root cutting cable laying plow 10, which is intended to be dragged through the earth in the direction of the arrow 12. The plow 10 includes a steel shank 20. The leading edge 24 of a lower portion 22 of the shank 20 is sharpened to form a blade 26 for cutting through the earth. The plow 10 is intended to be dragged through the earth at an angle as shown in FIG. 1; thus the lower end 28 of the shank 20 is cut at an angle so that the lower end 28 is parallel to the surface of the earth 14 when the plow 10 is in use.

Figure 3:
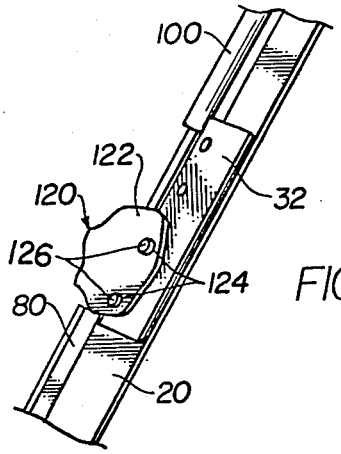
FIG. 3 is a partial perspective view of the root cutting cable laying plow of the invention installed to a tractor.

The shank 20 is provided with holes 30 therethrough for mounting to a tractor 120 as shown in FIG. 3. The tractor 120 may be provided with opposed parallel flanges 122 having cooperating holes 124. A pin 126 may be passed through a hole 124 in one flange 122, through a hole 30 in the shank and through a hole 124 in the other flange 122. Two such pins 126 are sufficient to attach the plow 10 to the tractor 120; however additional holes 30 may be provided in the shank 20 to permit adjustment of the towing depth of the plow 10. Spacer plates 32 may be attached to both sides of the shank 20 as required by the width of the gap between the parallel flanges 122 of the tractor 120.

Returning to FIG. 1, it can be seen that a cable chute 60 is attached to the trailing edge 34 of the shank 20 by pins 64 connecting lugs 36 of the shank 20 and lugs 62 of the cable chute 60. Cable 66 enters the top 70 of cable tube 68 of the cable chute 66, passes through cable tube 68 and exits from the cable chute 60 at its lower end 72 within the trench formed by the plow 10.

The shank 20 includes a flat surface 38 located above the blade 26 of the lower portion 22 of shank 20. Preferably the flat surface 38 is parallel to the lower end 28 of the shank 20. The shank 20 also includes longitudinal grooves 40 cut into opposite sides of the shank 20 above and behind the flat surface 38.

The plow 10 also includes a cutter 80 movable along the leading edge 24 of the shank 20. Ears 82 of the cutter 80 engage the grooves 40 of the shank 20 so as to permit such movement. The cutter 80 is preferably the same thickness as the shank 20. The leading edge 84 of the cutter 80 is sharpened into a blade 86 similar to the blade 26 along the leading edge 24 of the lower end 22 of the shank 20. When the cutter 20 is moved into its lowermost position, the blade 26 of the leading edge 24 of the lower end 22 of the shank 20 and the blade 86 of the leading edge 84 of the cutter 80 present a substantially continuous blade along the leading edge of the plow 10 from the lower end 28 of the shank to a point above the surface of the earth 16.

The lower end 88 of the cutter is also sharpened into a cutting edge 90. Cutting edge 90 of the cutter 80 and flat surface 38 of the shank 20 cooperate to form two cooperative cutting surfaces as a knife and an anvil capable of cutting any vegetable matter therebetween.

The cutter 80 may be moved in both directions along the shank 20 by a double acting hydraulic cylinder 100. The hydraulic cylinder is pinned to ears 44 of the upper end 42 of the shank 20. A piston rod of the hydraulic cylinder is pinned to the upper end 92 of the cutter 80. The hydraulic cylinder 100 is preferably remotely operable from the tractor 120 using the tractor's hydraulic system at typically 2250 psi. For a 30" trench depth, it has been found advantageous to provide a blade 26 of approximately 20" length on the shank 20 and a 3½" diameter hydraulic cylinder having a 22" stroke.

The hydraulic cylinder 100 is located above the mounting holes 30 of the shank 20. As can be seen in FIG. 3, this placement positions the hydraulic cylinder 100 above the parallel flanges 122 of the tractor 120, so that the diameter of the hydraulic cylinder 100 is not limited by the gap between the parallel flanges 122. The rod 102, which has a smaller diameter than the hydraulic cylinder 100, and the cutter 80, which is preferably no thicker than the shank 20, can freely move along the leading edge of the shank 20 between the parallel flanges 122.

In use, the root cutting cable laying plow 10 is attached to the tractor 120 and dragged through the earth in the same manner as prior art cable laying plows except that the hydraulic cylinder 100 is connected to the tractor 120 by hoses 104 as shown in FIG. 1. The plow 10 is preferably dragged with the cutter 80 in its lowermost position so that the blade 26 of the shank 20 and the blade 86 of the cutter 80 present a substantially uninterrupted blade from the lower end 28 of the shank 20 to the surface of the earth 14. As roots and other vegetable matter accumulate along the leading edge of the plow 10, forward motion of the forwarding angled plow 10 will urge them upwardly to the surface of the earth 14 adjacent the cutter 80. As roots accumulate, the tractor operator raises the cutter 80, allowing the roots to enter the gap created between the flat surface 38 of the shank 20 and the cutting edge 90 of the cutter 80. The operator then lowers the cutter 80, cutting, crushing and severing the roots and other vegetable matter therebetween. The operator may repeat the operation as necessary without leaving the tractor 120.

Thus it is apparent that there has been provided, in accordance with the invention, a root cutting cable laying plow that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A cable laying plow adapted for attachment to a tractor, said plow comprising:

(a) an elongated shank having a blade formed along a lower portion of a leading edge of said shank and further having a first cooperative cutting surface above the blade;

(b) a cutter movably attached to said shank and having a second cooperative cutting surface with said second cutting surface being movable into engagement with said first cutting surface so as to crush and cut vegetable matter between said first and second cutting surfaces; and (c) means for urging the second cooperative cutting surface of the cutter into engagement with the first cooperative cutting surface of the shank.

2. The plow of claim 1 wherein one of said first and second cutting surfaces is a blade.

3. The plow of claim 2 wherein the other of said first and second cutting surfaces in an anvil.

4. The plow of claim 1 further including a cable chute adjacent a trailing edge of the shank.

5. The plow of claim 1 wherein the cutter is movable along the shank.

6. The plow of claim 5 wherein a blade is formed in a leading edge of the cutter.

7. The plow of claim 5 wherein said shank has longitudinal grooves formed in opposing sides thereof and wherein said cutter has ears engageable within said grooves.

8. The plow of claim 7 wherein the bottom surface of the shank is parallel to both of the first and second cooperative cutting surfaces.

9. The plow of claim 1 wherein the means for urging includes a double-acting hydraulic cylinder, piston and rod apparatus attached to both the shank and the cutter.

10. The plow of claim 9 wherein said plow is adapted for mounting between opposed flanges of the tractor and the hydraulic cylinder is located above the opposed flanges and the rod passes between the flanges and the rod and the cutter are both movable between the flanges.

11. A cable laying plow adapted for attachment to a tractor, said plow comprising:

(a) an elongated shank having a blade formed along a lower portion of a leading edge of said shank, a flat cutting surface above the blade, and longitudinal grooves along opposed sides of a portion of said shank;

(b) a cutter having flanges engaged with said grooves, said cutter being movable along said shank to a position where a sharpened lower end of said cutter engages the flat cutting surface of the shank; and (c) a double-acting hydraulic cylinder attached to an upper end of said shank and having a rod attached to said cutter so as to urge the sharpened lower end of said cutter into and out of engagement with said flat cutting surface of said shank.

* * * * *